US006764167B2

(12) United States Patent
Shimada et al.

(10) Patent No.: US 6,764,167 B2
(45) Date of Patent: Jul. 20, 2004

(54) INK-JET RECORDING HEAD INKJET RECORDING APPARATUS

(75) Inventors: Masato Shimada, Nagano-ken (JP); Yoshinao Miyata, Nagano-ken (JP); Hiroyuki Kamei, Nagano-ken (JP); Tetsushi Takahashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/446,937

(22) Filed: May 29, 2003

(65) Prior Publication Data

US 2003/0214561 A1 Nov. 20, 2003

Related U.S. Application Data

(62) Division of application No. 09/977,380, filed on Oct. 16, 2001, now abandoned.

(30) Foreign Application Priority Data

Oct. 16, 2000 (JP) ..... 2000-315607

(51) Int. Cl.[7] ..... B41J 2/045
(52) U.S. Cl. ..... 347/68
(58) Field of Search ..... 347/68, 70, 71

(56) References Cited

FOREIGN PATENT DOCUMENTS

| | | |
|---|---|---|
| EP | 0 899 107 A2 | 3/1999 |
| EP | 0 903 234 A2 | 3/1999 |
| EP | 0 943 437 A1 | 9/1999 |
| EP | 0 963 846 A2 | 12/1999 |
| EP | 0 976 560 A2 | 2/2000 |
| JP | 5-286131 | 11/1993 |
| JP | 10-081016 | 3/1998 |
| JP | 11-157062 | 6/1999 |
| JP | 2000-272125 | 10/2000 |

*Primary Examiner*—Judy Nguyen
(74) *Attorney, Agent, or Firm*—Sughrue Mion, PLLC

(57) ABSTRACT

Disclosed are an ink-jet recording head, in which nozzles can be arrayed in high density and a manufacturing cost thereof is reduced, and an ink-jet recording apparatus. In an ink-jet recording head, comprising: a pressure generating chamber (12) communicating with a nozzle orifice; and a piezoelectric element (300) having a lower electrode (60), a piezoelectric layer (70) and an upper electrode (80), the piezoelectric element (300) being provided in a region corresponding to the pressure generating chamber (12) with a vibration plate interposed therebetween, the piezoelectric element (300) includes a piezoelectric active portion (320) as a substantial drive portion and a piezoelectric non-active portion (330) having the piezoelectric layer (70) continuous from the piezoelectric active portion (320) but not being substantially driven, and a stress suppression layer (100) for suppressing stress due to drive of the piezoelectric element (300) is provided, straddling a boundary between the piezoelectric active portion (320) and the piezoelectric non-active portion (330).

14 Claims, 8 Drawing Sheets

INK-JET RECORDING HEAD INKJET RECORDING APPARATUS

This is a divisional of application Ser. No. 09/977,380, filed on Oct. 16, 2001, now abandoned, the disclosure of which is incorporated herein by reference.

BACKGROUND OF THE INVENTION

The present invention relates to an ink-jet recording head for ejecting ink droplets by displacing a piezoelectric element, in which a vibration plate constitutes a part of a pressure generating chamber communicating with a nozzle orifice that ejects ink droplets, and the piezoelectric element is provided through the vibration plate. Moreover, the present invention relates to an ink-jet recording apparatus.

As an ink-jet recording head for ejecting ink droplets from a nozzle orifice, in which a vibration plate constitutes a part of a pressure generating chamber communicating with a nozzle orifice that ejects ink droplets, and the vibration plate is deformed by the piezoelectric element to pressurize ink in the pressure generating chamber, the following two types have been put into practical use; one is an ink-jet recording head that uses a piezoelectric actuator of a longitudinal vibration mode, which stretches and contracts in an axial direction of the piezoelectric element, and the other one uses a piezoelectric actuator of a flexural vibration mode.

The ink-jet recording head of the former type has had an advantage that it can change a volume of the pressure generating chamber by allowing an end face of the piezoelectric element to abut on the vibration plate, thus making it possible to manufacture a head suitable for high-density printing. However, this type of ink-jet recording head has a problem of complicated manufacturing steps due to: a necessity of a troublesome step of cutting and dividing the piezoelectric element into a comb-tooth shape so as to coincide with an array pitch of the nozzle orifices; and a necessity of an operation of positioning and fixing the cut and divided piezoelectric elements onto the pressure generating chambers.

Meanwhile, the ink-jet recording head of the latter type has had an advantage that the piezoelectric element can be fixedly installed to the vibration plate through relatively simple steps of adhering a green sheet of a piezoelectric material to the vibration plate so as to match the pressure generating chamber in shape and of sintering the same. However, this type of ink-jet recording head has a problem of difficulty in arraying the pressure generating chambers in high density due to a necessity of a certain amount of area because of utilization of the flexural vibration.

In order to solve a disadvantage of the ink-jet recording head of the latter type, as disclosed in Japanese Patent Laid-Open No. Hei 5(1993)-286131, an ink-jet recording head has been proposed in which a piezoelectric material layer having an even thickness is formed over the entire surface of a vibration plate by a film growth technology, and this piezoelectric material layer is then cut and divided by a lithography method so that a shape of each piece of the layer can correspond to a shape of each pressure generating chamber, thus forming each piezoelectric element so as to be independent for each pressure generating chamber.

According to the ink-jet recording head as described above, advantages obtained are, not only that the operation of adhering the piezoelectric element to the vibration plate becomes unnecessary, and that the piezoelectric element can be fixedly installed to the vibration plate by a precise and simple method called the lithography method, but also that the piezoelectric element can be made thin to make a high-speed drive thereof possible.

Moreover, in this case, providing at least an upper electrode to each pressure generating chamber while leaving the piezoelectric material layer being provided on the entire surface of the vibration plate makes it possible to drive the piezoelectric element corresponding to each pressure generating chamber. However, it is desirable that a piezoelectric active portion having a piezoelectric layer and the upper electrode be formed so as not to be located outside the pressure generating chamber, since there are problems of a displacement amount per unit drive voltage and stress applied to the piezoelectric layer in a portion that straddles a portion facing towards the pressure generating chamber and outside thereof.

In this connection, a structure has been known in which an insulating layer covers the piezoelectric element corresponding to each pressure generating chamber, and a window (hereinafter, referred to as a contact hole) for forming a connection portion between each piezoelectric element and a lead electrode supplying a voltage to drive each piezoelectric element is provided in the insulating layer so as to correspond to each pressure generating chamber, thus forming the connection portion between each piezoelectric element and the lead electrode in the contact hole.

However, in the structure as described above in which the contact hole is provided for connecting the upper electrode and the lead electrode, there has been a problem that the entire film thickness of the portion provided with the contact hole becomes thick, thus lowering a displacement characteristic.

In order to solve the above-described problems, a structure has been proposed in which a piezoelectric non-active portion having a piezoelectric layer but not being substantially driven is provided in a region facing towards the pressure generating chamber in continuation with the piezoelectric active portion as a substantial drive portion of the piezoelectric element, thus forming the lead electrode without providing the contact hole.

SUMMARY OF THE INVENTION

However, in the structure as described above, the piezoelectric active portion becomes deformed when the piezoelectric element is driven by application of a voltage. And, there is a problem that damage such as a crack occurs in a boundary portion between the piezoelectric active portion and the piezoelectric non-active portion due to a drastic stress change generated therebetween.

Moreover, the above problem tends to occur particularly in the case where the piezoelectric material layer is formed by the film growth technology. This is because rigidity of the piezoelectric material layer is low in comparison with that of a piezoelectric material layer to which a bulk piezoelectric element is adhered since that the piezoelectric material layer formed by the film growth technology is very thin.

In consideration of circumstances as described above, the present invention has an object to provide an ink-jet recording head and an ink-jet recording apparatus in which damage to of the piezoelectric layer due to the drive of the piezoelectric element is prevented.

A first aspect of the present invention for solving the above-described problems is an ink-jet recording head, comprising: a pressure generating chamber communicating with a nozzle orifice; and a piezoelectric element having a lower electrode, a piezoelectric layer and an upper electrode, the piezoelectric element being provided in a region corresponding to the pressure generating chamber with a vibration plate interposed therebetween, wherein the piezoelectric element includes a piezoelectric active portion as a substantial drive portion and a piezoelectric non-active portion having the piezoelectric layer continuous from the piezoelectric active portion but not being substantially driven in a region facing to the pressure generating chamber, and a stress suppression layer for suppressing stress due to drive of the piezoelectric element is provided straddling a boundary between the piezoelectric active portion and the piezoelectric non-active portion.

In the first aspect, when the piezoelectric element is driven, the stress at the boundary between the piezoelectric active portion and the piezoelectric non-active portion of the piezoelectric element is suppressed, and damage to the piezoelectric layer is prevented.

A second aspect of the present invention is the ink-jet recording head according to the first aspect, wherein the piezoelectric layer has crystals subjected to a priority orientation.

In the second aspect, as a result of depositing the piezoelectric layer in a thin-film process, the crystals are subjected to the priority orientation.

A third aspect of the present invention is the ink-jet recording head according to the second aspect, wherein the piezoelectric layer has crystals shaped in a columnar shape.

In the third aspect, as a result of depositing the piezoelectric layer in the thin-film process, the crystals are shaped in the columnar shape.

A fourth aspect of the present invention is the ink-jet recording head according to any one of the first to third aspects, wherein the piezoelectric non-active portion is formed by removing the lower electrode.

In the fourth aspect, the piezoelectric non-active portion can be readily formed by removing the lower electrode.

A fifth aspect of the present invention is the ink-jet recording head according to any one of the first to fourth aspects, wherein a film thickness of the piezoelectric layer ranges from 0.5 to 3 $\mu$m.

In the fifth aspect, the film thickness of the piezoelectric layer is made relatively thin, and thus the head can be miniaturized.

A sixth aspect of the present invention is the ink-jet recording head according to any one of the first to fifth aspects, wherein at least the piezoelectric layer constituting the piezoelectric element is independently formed in the region opposite with the pressure generating chamber.

In the sixth aspect, a displacement amount of the vibration plate due to the drive of the piezoelectric element is increased.

A seventh aspect of the present invention is the ink-jet recording head according to the sixth aspect, wherein a wiring electrode is extended from the upper electrode toward a region of a peripheral wall the pressure generating chamber.

In the seventh aspect, the upper electrode of the piezoelectric element and the external wiring can be connected relatively readily with the wiring electrode interposed therebetween.

An eighth aspect of the present invention is the ink-jet recording head according to the seventh aspect, wherein the wiring electrode also serves as the stress suppression layer.

In the eighth aspect, since the wiring electrode also serves as the stress suppression layer, a structure of the ink-jet recording head can be simplified, and a manufacturing cost thereof can be reduced.

A ninth aspect of the present invention is the ink-jet recording head according to any one of the first to eighth aspects, wherein the stress suppression layer includes an insulating layer made of an insulating material.

In the ninth aspect, the stress applied to the piezoelectric element is suppressed without short-circuiting the wiring of the piezoelectric element, and thus damage to the piezoelectric layer can be more securely prevented.

A tenth aspect of the present invention is the ink-jet recording head according to any one of the first to ninth aspects, wherein a width of an end portion of the stress suppressing layer on the piezoelectric active portion side is gradually reduced toward a tip thereof.

In the tenth aspect, since the stress applied to the piezoelectric element gradually changes in the vicinity of the boundary between the piezoelectric active portion and the piezoelectric non-active portion, damage to the piezoelectric layer due to the radical stress change at the boundary is prevented.

An eleventh aspect of the present invention is the ink-jet recording head according to any one of the first to tenth aspects, wherein the stress suppression layer is formed to have a width wider than a width of the pressure generating chamber in an outer region than the boundary between the piezoelectric active portion and the piezoelectric non-active portion, and the vibration plate in a region opposite with an edge portion of a longitudinal direction of the pressure generating chamber is covered with the stress suppression layer.

In the eleventh aspect, rigidity of the vibration plate is enhanced in the edge portion of the longitudinal direction of the pressure generating chamber, and thus damage to the vibration plate due to the drive of the piezoelectric element is prevented.

A twelfth aspect of the present invention is the ink-jet recording head according to any one of the first to eleventh aspects, wherein the pressure generating chamber is formed by subjecting a single crystal silicon substrate to anisotropic etching, and each layer of the piezoelectric element is formed of a thin film by a lithography method.

In the twelfth aspect, the pressure generating chamber can be formed relatively readily with high accuracy and high density.

A thirteenth aspect of the present invention is an ink-jet recording apparatus comprising the ink-jet recording head according to any one of the first to twelfth aspects.

In the thirteenth aspect, the ink-jet recording head can be realized in which durability and reliability of the head are improved.

BRIEF DESCRIPTION OF THE DRAWINGS

For a more complete understanding of the present invention and the advantages thereof, reference is now made to the following descriptions in conjunction with the accompanying drawings.

FIG. 2A is a plan view; and FIG. 2B is a sectional view.

FIG. 5A is a plan view; and FIG. 5B is a sectional view.

FIG. 7A is a plan view; and FIG. 7B is a sectional view.

DESCRIPTION OF THE PREFERRED EMBODIMENTS

Hereinafter, description will be made in detail for the present invention based on embodiments.

(Embodiment 1)

Figure 1:
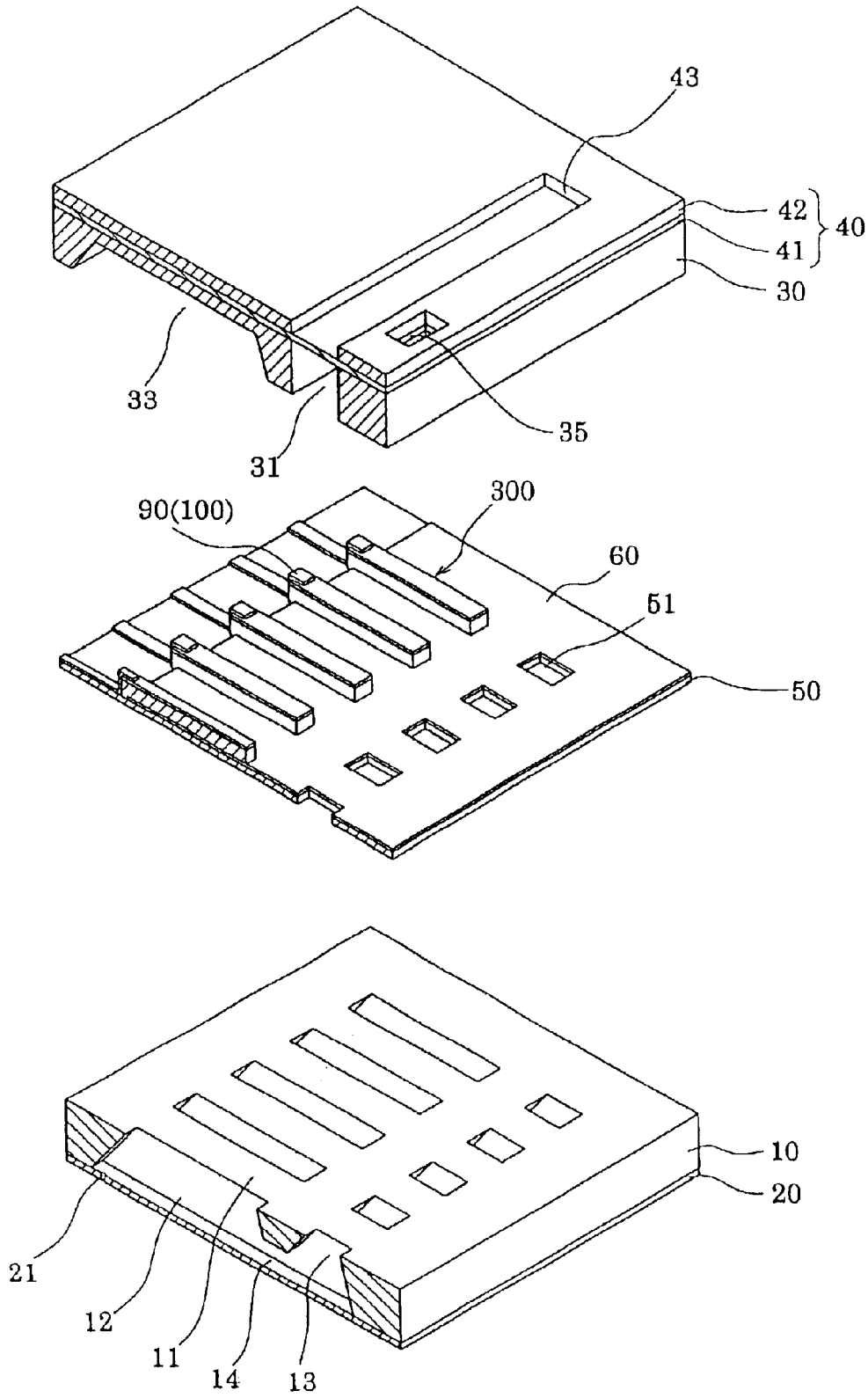
FIG. 1 is a perspective view schematically showing an ink-jet recording head according to embodiment 1 of the present invention.
Figure 2A:
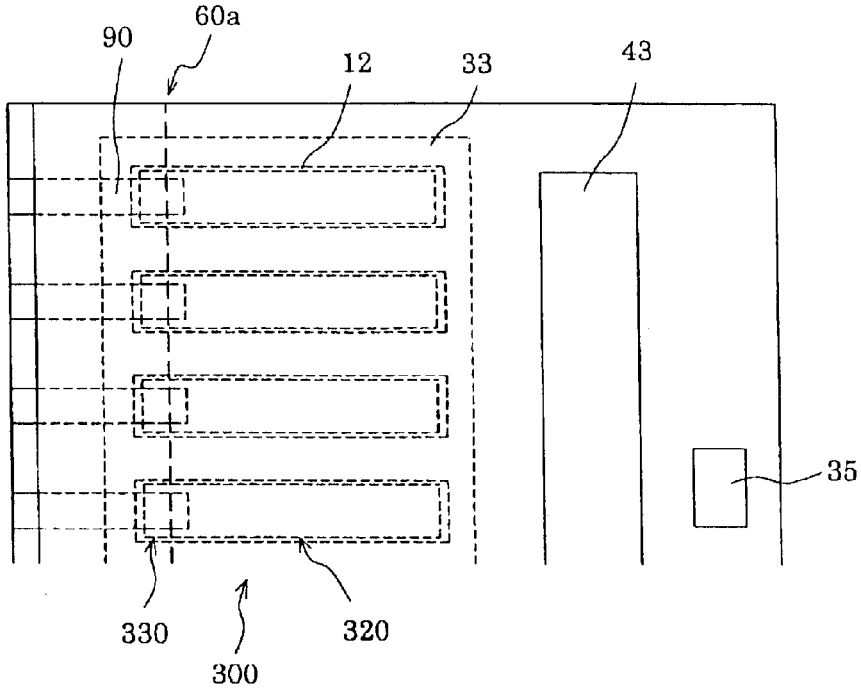
FIGS. 2A and 2B are views of the ink-jet recording head according to embodiment 1 of the present invention.
Figure 2B:
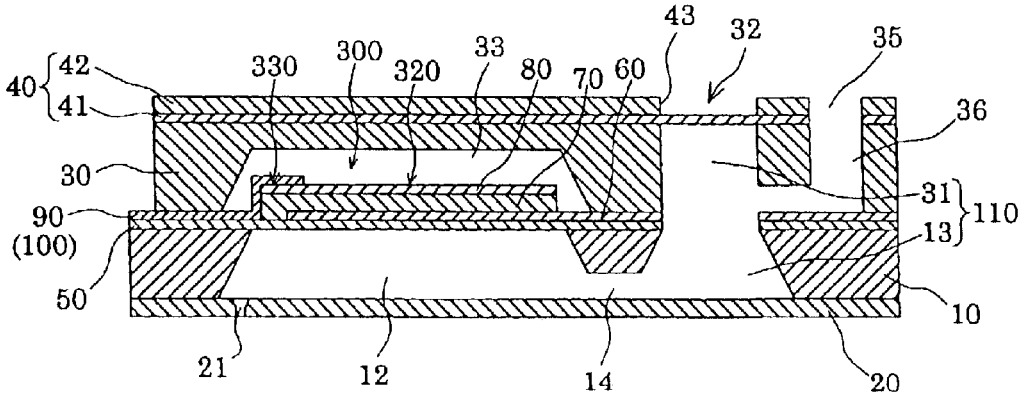

FIG. 1 is an exploded perspective view showing an ink-jet recording head according to embodiment 1 of the present invention, FIG. 2A is a plan view of FIG. 1, and FIG. 2B is a sectional view thereof.

As shown in the drawings, a passage-forming substrate 10 consists of a single crystal silicon substrate of a plane orientation (110) in this embodiment. One surface of the passage-forming substrate 10 becomes an opening surface. And on the other surface thereof, an elastic film 50 having a thickness of 1 to 2 μm is formed, which is made of silicon dioxide formed in advance by thermal oxidation.

In the passage-forming substrate 10, by subjecting the single crystal silicon substrate to anisotropic etching, pressure generating chambers 12 partitioned by a plurality of compartment walls 11 are parallelly provided in a width direction of the pressure generating chambers 12, and on the outside of a longitudinal direction thereof, a communicating portion 13 is formed and made to communicate with one end portion of a longitudinal direction of each pressure generating chamber 12 through an ink supply path 14. Here, the communicating portion 13 constitute a part of a reservoir 110 that communicates with a reservoir portion of a reservoir-forming substrate to be described later and becomes a common ink chamber of the respective pressure generating chambers 12.

Here, the anisotropic etching is performed while utilizing a difference between etching rates of the single crystal silicon substrate. For example, in this embodiment, the anisotropic etching is carried out by use of the following property of the single crystal silicon substrate regarding the etching rate. Specifically, when the single crystal silicon substrate is immersed in an alkaline solution such as KOH, it is gradually eroded, and there emerges a first plane (111) perpendicular to the (110) plane. At the same time, a second plane (111) also emerges forming an angle of about 70° with respect to the first plane (111) and forming an angle of about 35° with respect to the plane (110). In this case, an etching rate of the plane (111) is about 1/180 as compared with an etching rate of the plane (110). By the anisotropic etching as described above, high precision processing can be carried out on the basis of depth processing of a shape of a parallelogram formed of two first planes (111) and two second slant planes (111). Thus, the pressure generating chambers 12 can be arrayed in high density.

In this embodiment, long sides of each pressure generating chamber 12 are formed of the first planes (111), and short sides thereof are formed of the second planes (111). The pressure generating chamber 12 is formed by etching the passage-forming substrate 10 so that the etching can virtually penetrate the same substrate and reach the elastic film 50. Here, an amount of the elastic film 50 eroded by the alkaline solution for etching the single crystal silicon substrate is very small. Moreover, each ink supply path 14 communicating with the one end of each pressure generating chamber 12 is formed to be shallower than the pressure generating chamber 12 and maintains passage resistance of ink flowing into the pressure generating chamber 12 constant. Specifically, the ink supply path 14 is formed by etching the single crystal silicon substrate partway in a thickness direction (half etching). Note that such half etching is carried out by adjusting the etching time.

Note that, with regard to the thickness of the passage-forming substrate 10 as described above, an optimal thickness is selected in accordance with a density in which the pressure generating chambers 12 are arranged. For example, when disposing the pressure generating chambers 12 to obtain resolution of 180 dpi, it is preferable that the thickness of the passage-forming substrate 10 be set in a range of about 180 to 280 μm, more preferably, about 220 μm. Moreover, for example, when disposing the pressure generating chambers 12 to obtain resolution of 360 dpi, it is preferable that the thickness of the passage-forming substrate 10 be set equal to 100 μm or less. This is because the array density can be increased while maintaining rigidity of the compartment wall between the pressure generating chambers adjacent to each other.

Moreover, on the other surface of the passage-forming substrate 10, a nozzle plate 20 with nozzle orifices 21 drilled therein, is fixedly attached with an adhesive, a thermowelding film or the like interposed therebetween. The nozzle orifice 21 communicates with the pressure generating chamber 12 on the other side from where the ink supply path 14 communicates with the pressure generating chamber 12. Note that the nozzle plate 20 is made of glass ceramics or stainless steel having a thickness of, for example, 0.1 to 1 mm and having a linear expansion coefficient of, for example, $2.5\times10^{-6}$/° C. to $4.5\times10^{-6}$/° C. at a temperature of 300° C. or lower. One surface of the nozzle plate 20 entirely covers one surface of the passage-forming substrate 10 and also plays a role of a reinforcement plate protecting the single crystal silicon substrate from a shock or external force. Furthermore, the nozzle plate 20 may be formed of a material having a thermal expansion coefficient approximately equal to that of the passage-forming substrate 10. In this case, since the passage-forming substrate 10 and the nozzle plate 20 are deformed in approximately the same manner by heat, the passage-forming substrate 10 and the nozzle plate 20 can be readily joined to each other by use of a thermosetting adhesive or the like.

Here, a size of the pressure generating chamber 12 imparting an ink droplet ejection pressure to ink and a size of the nozzle orifice 21 ejecting ink droplets are optimized in accordance with an ejection quantity, an ejection speed and an ejection frequency of ink droplets. For example, when recording 360 ink droplets per inch, the nozzle orifice 21 must be formed precisely in diameter of several ten μm.

Meanwhile, on the elastic film 50 provided on the passage-forming substrate 10, a lower electrode film 60 having a thickness of, for example, about 0.2 μm, a piezoelectric layer 70 having a thickness of, for example, about 1 μm and an upper electrode film 80 having a thickness of, for example, about 0.1 μm are formed in a laminated manner by a process to be described later, thus constituting a piezoelectric element 300. Here, in principle the piezoelectric element 300 means a portion including the lower electric film 60, the piezoelectric layer 70 and the upper electrode film 80. In general, one of the electrodes of the piezoelectric element 300 is used as a common electrode, and the other electrode and the piezoelectric layer 70 are patterned for each pressure generating chamber 12, thus constituting the piezoelectric element 300. Here, a portion that is constituted of the piezoelectric layer 70 and one of the patterned electrodes and has piezoelectric strain caused by application of a voltage to the electrode is called a piezoelectric active portion 320. In this embodiment, the lower electrode film 60 is used as the common electrode of the piezoelectric element 300, and the upper electrode 80 is used as an individual electrode of the piezoelectric element 300. However, using the lower electrode 60 as the individual electrode and using the upper electrode 80 as the common electrode for the sake of convenience of a drive circuit and wiring would cause no problems. In any case, the piezoelectric active portion is formed for each pressure generating chamber. Furthermore, here, the piezoelectric element 300 and a vibration plate that is displaced due to drive of the piezoelectric element 300 are collectively referred to as a piezoelectric actuator.

Here, description will be made in detail for the structure of the piezoelectric element 300 as described above.

As shown in FIGS. 2A and 2B, the lower electrode film 60 constituting a part of the piezoelectric elements 300 is continuously provided on an opposing region where the plurality of pressure generating chambers 12 are provided in parallel and is patterned in the vicinity of one end portion of the longitudinal direction of each of the pressure generating chambers 12. Specifically, the piezoelectric element 300 includes the piezoelectric active portion 320 as a substantial drive portion and the piezoelectric non-active portion 330 having the continuous piezoelectric layer 70 but not being driven. Also, an end portion 60*a* of the patterned lower electrode film 60 becomes an end portion of the piezoelectric active portion 320.

Moreover, in this embodiment, the piezoelectric active portion 320 and the piezoelectric non-active portion 330 which constitute the piezoelectric element 300 are formed independently of each other in the region opposite with the pressure generating chamber 12. Specifically, the piezoelectric layer 70 and the upper electrode film 80 are patterned in the region opposite with the pressure generating chamber 12, and the upper electrode film 80 is connected to external wiring (not shown) through a lead electrode 90 extending from the vicinity of the one end portion of the longitudinal direction of the piezoelectric element 300 to the elastic film 50.

Here, the lead electrode 90 also serves as a stress suppression layer 100 for suppressing stress when the piezoelectric element 300 is being driven and is extended from the region facing to the piezoelectric active portion 320 through an upper surface of the piezoelectric non-active portion 330 to the elastic film 50. Specifically, the lead electrode 90 is provided straddling a boundary between the piezoelectric active portion 320 and the piezoelectric non-active portion 330.

In the above-described manner, rigidity of the vicinity of the end portion of the longitudinal direction of the piezoelectric element 300 is enhanced, and thus the stress applied to the piezoelectric element 300 while being driven can be suppressed. Since a displacement amount at the end portion of the longitudinal direction of the piezoelectric element 300 is reduced when the piezoelectric element 300 is driven, damage to the piezoelectric layer 70 such as occurrence of a crack due to repeated displacement and the like can be hence prevented. Moreover, particularly, since the lead electrode 90 is formed straddling the boundary between the piezoelectric active portion 320 and the piezoelectric non-active portion 330, a radical stress change at the boundary between the piezoelectric active portion 320 and the piezoelectric non-active portion 330 can be prevented, and damage to the piezoelectric layer 70 accompanied with this stress change can be thus effectively prevented.

Hereinafter, description will be made for a process of forming the piezoelectric element 300 as described above and the like on the passage-forming substrate 10 having the single crystal silicon substrate with reference to FIGS. 3A to 4D. Note that FIGS. 3A to 4D are sectional views of a longitudinal direction of the pressure generating chamber 12.

Figure 3A:
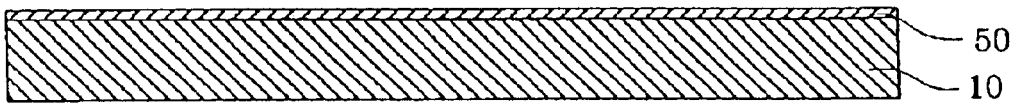
FIGS. 3A to 3D are sectional views showing a manufacturing process of the ink-jet recording head according to embodiment 1 of the present invention.

First, as shown in FIG. 3A, a wafer of the single crystal silicon substrate that will become the passage-forming substrate 10 is subjected to thermal oxidation in a diffusion furnace at about 1100° C., thus forming the elastic film 50 made of silicon dioxide.

Figure 3B:
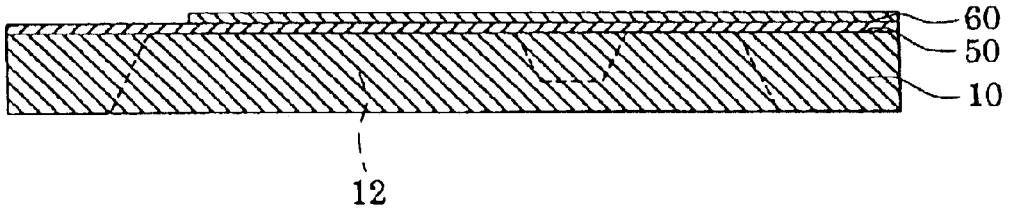

Next, as shown in FIG. 3B, the lower electrode film 60 is formed on the entire surface of the elastic film 50 by sputtering, then the lower electrode film 60 is patterned to form the entire pattern. Platinum is preferred as a material of the lower electrode film 60. This is because the piezoelectric layer 70, as described later, deposited by a sputtering method or a sol-gel method must be sintered at a temperature ranging from 600 to 1000° C. in an atmosphere or an oxygen atmosphere after the deposition and then crystallized. Specifically, the material of the lower electrode film 60 must be able to maintain conductivity at such a high temperature and in such an oxidation atmosphere. Especially, when using lead zirconium titanate (PZT) as the piezoelectric layer 70, change in conductivity due to diffusion of lead oxide is desirably small. Platinum is preferred for these reasons.

Figure 3C:
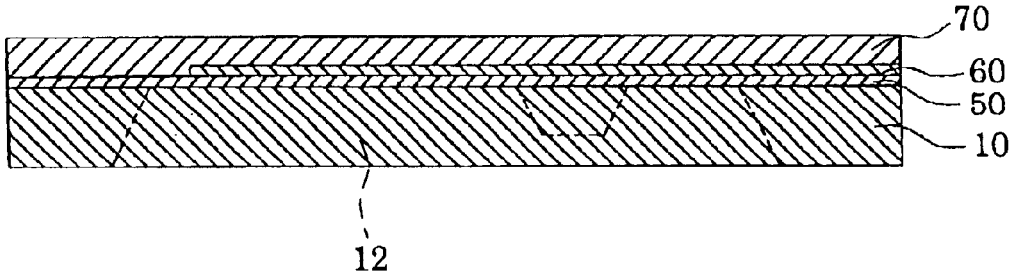

Next, as shown in FIG. 3C, the piezoelectric layer 70 is deposited. It is preferable that crystals of the piezoelectric layer 70 be oriented. For example, in this embodiment, the piezoelectric layer 70 having the crystals oriented is formed by use of a so-called sol-gel method. In this method, a so-called sol obtained by dissolving/dispersing metal organic matter in catalyst is coated and dried to turn itself into gel, and the obtained gel is further sintered at a high temperature to obtain the piezoelectric film 70 made of metal oxide. A lead zirconium titanate-series material is preferred as a material of the piezoelectric layer 70 when it is used for the ink-jet recording head. Note that, the film deposition method of the piezoelectric layer 70 is not particularly limited, and for example, the piezoelectric layer 70 may be formed by a sputtering method.

Furthermore, a method may be employed in which a precursor film of the lead zirconium titanate is formed by the sol-gel method or the sputtering method, followed by crystal growth at a low temperature in an alkaline solution by use of a high-pressure treatment method.

In any case, the piezoelectric layer 70 thus deposited has crystals subjected to priority orientation unlike bulk piezoelectric matters, and in this embodiment, the piezoelectric layer 70 has the crystals formed in a columnar shape. Note that the priority orientation refers to a state where the orientation direction of the crystals is not in disorder but a specified crystal face faces in an approximately fixed direction. In addition, the thin film having crystals in a columnar shape refers to a state where the approximately columnar crystals gather across the plane direction while center axes thereof are made approximately coincident with the thickness direction. It is a matter of course that the piezoelectric layer 70 may be a thin film formed of particle-shaped crystals subjected to the priority orientation. Note that a thickness of the piezoelectric layer thus manufactured in the thin film step is typically 0.2 to 5 m.

Figure 3D:
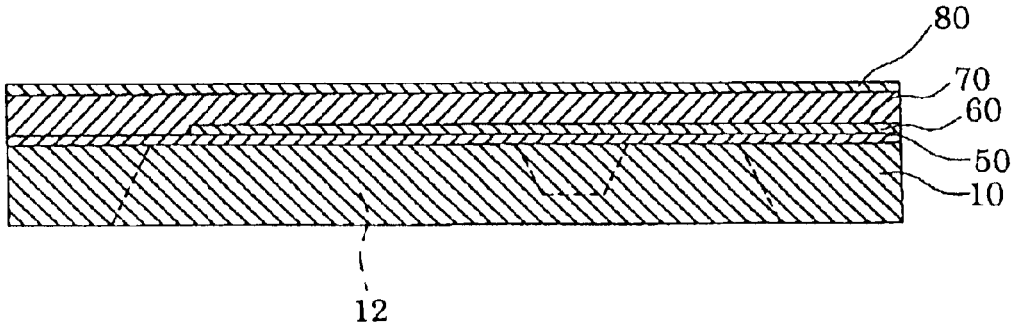

Next, as shown in FIG. 3D, the upper electrode film 80 is deposited. It is satisfactory if the upper electrode film 80 is made of a material with high conductivity, and various kinds of metals such as aluminum, gold, nickel and platinum, or conductive oxide and the like can be used. In this embodiment, platinum is deposited by sputtering.

Figure 4A:
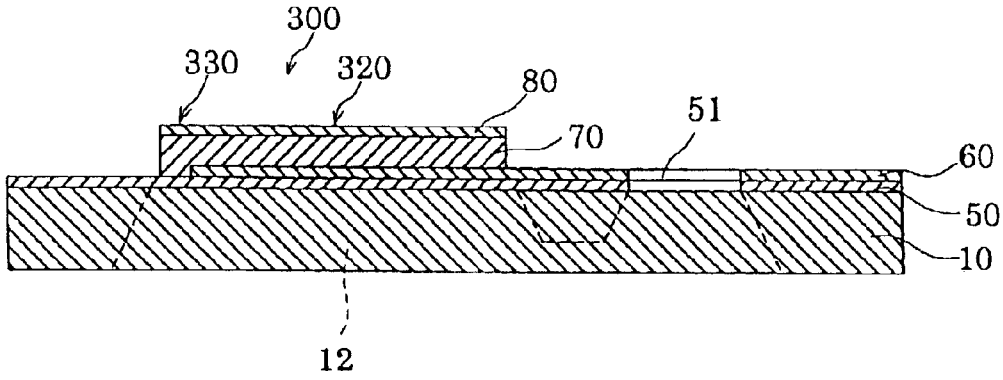
FIGS. 4A to 4C are sectional views showing the manufacturing process of the ink-jet recording head according to embodiment 1 of the present invention.

Subsequently, as shown in FIG. 4A, only the piezoelectric layer 70 and the upper electrode film 80 are etched, and the piezoelectric element 300 having the piezoelectric active portion 320 and the piezoelectric non-active portion 330 is patterned. Specifically, in the region opposite with the pressure generating chamber 12, a region where the lower electrode film 60 is formed becomes the piezoelectric active portion 320, and a region where the lower electrode film 60 is removed becomes the piezoelectric non-active portion 330.

Figure 4B:
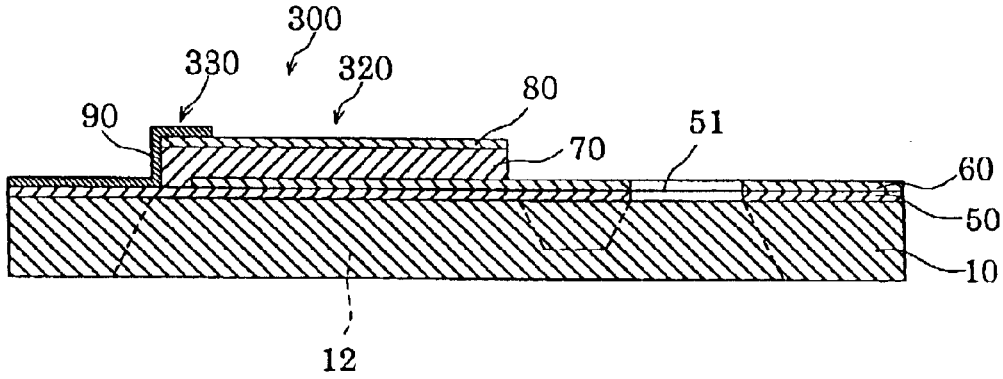

Next, as shown in FIG. 4B, the lead electrode 90 also serving as the stress suppression layer 100 is formed. Specifically, for example, the lead electrode 90 made of gold (Au) or the like is formed across the entire surface of the passage-forming substrate 10 and is patterned for each piezoelectric element 300. In this case, the lead electrode 90 is formed so as to straddle the boundary between the piezoelectric active portion 320 and the piezoelectric non-active portion 330. Note that the lead electrode 90 may be provided with an adhesion layer made of nickel (Ni) or the like between the lead electrode 90 and the passage-forming substrate 10.

Figure 4C:
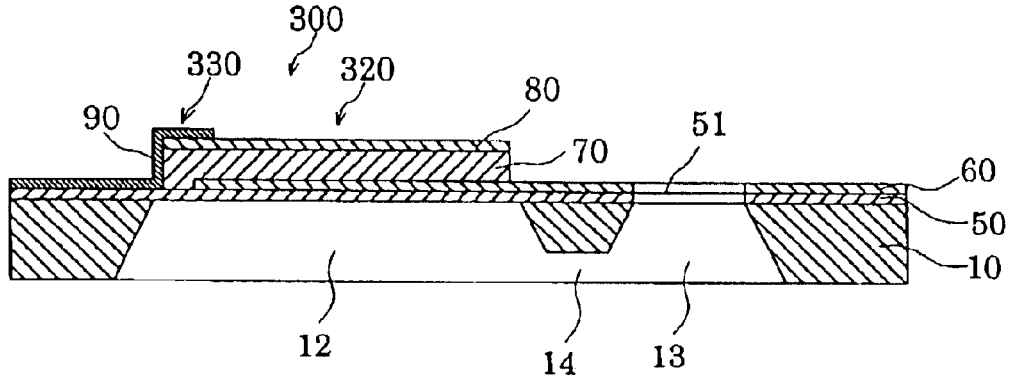

As seen above, description has been made for the film forming process. After the film is formed in such a manner, the above-described anisotropic etching is performed on the single crystal silicon substrate by use of the alkaline solution. As shown in FIG. 4C, thus formed are the pressure generating chamber 12, the communicating portion 13, the ink supply path and the like.

Note that, in actual practice, a large number of chips are simultaneously formed on one wafer by such a series of film formation and anisotropic etching. After completing the process, the wafer is divided into each pressure generating chamber 10 having one chip size as shown in FIG. 1. Then, a reservoir-forming substrate 30 and a compliance substrate 40, which are to be described later, are sequentially glued on the divided passage-forming substrate 10 and integrated, thus forming the ink-jet recording head.

Specifically, as shown in FIG. 1 and FIGS. 2A and 2B, the reservoir-forming substrate 30 having a reservoir portion 31 constituting at least one part of the reservoir 110 is joined onto the surface of the passage forming substrate 10 in which the pressure generating chamber 12 and the like are formed, the surface having the piezoelectric element 300 thereon. In this embodiment, the reservoir portion 31 is formed across the width direction of the pressure generating chamber 12, penetrating the reservoir-forming substrate 30 in the thickness direction. The reservoir portion 31 is made to communicate with the communication portion 13 of the passage forming substrate 10 through a penetration hole 51 provided by penetrating the elastic film 50 and the lower electrode film 60, thus constituting the reservoir 110 as a common ink chamber of the respective pressure generating chambers 12.

As the reservoir-forming substrate 30, a material such as glass or ceramics for example, having a thermal expansion ratio approximately equal to that of the passage-forming substrate 10 is preferably used. In this embodiment, the reservoir-forming substrate 30 is formed of the single crystal silicon substrate, which is made of the same material as that of the passage-forming substrate 10. Thus, similarly to the case of the above-described nozzle plate 20, the reservoir-forming substrate 30 and the passage-forming substrate 10 can be securely glued together even by adhesion at a high temperature using the thermosetting adhesive. Hence, the manufacturing process can be simplified.

Furthermore, the compliance plate 40 having a sealing film 41 and a fixing film 42 is joined on the reservoir-forming substrate 30. Here, the sealing film 41 is made of a material having low rigidity and flexibility (for example, a polyphenylene sulfide (PPS) film having a thickness of 6 $\mu$m). The sealing film 41 seals one opening of the reservoir portion 31. Moreover, the fixing plate 42 is formed of a hard material such as metal (for example, stainless steel (SUS) having a thickness of 30 $\mu$m). A region of the fixing plate 42 facing to the reservoir 110 becomes an opening portion 43 obtained by entirely removing the fixing plate 42 in the thickness direction. Therefore, the one opening of the reservoir 110 is sealed only by the sealing film 41 having flexibility, and the sealed opening becomes a flexible portion 32 deformable in accordance with change of inner pressure of the reservoir 110.

Moreover, at an approximately central portion in the longitudinal direction of the reservoir 110 on an outer side of the compliance substrate 40, an ink introducing port 35 for supplying ink to the reservoir 110 is formed. Furthermore, an ink introducing path 36 is provided in the reservoir forming substrate 30 to allow the ink introducing port 35 and a sidewall of the reservoir 110 to communicate with each other.

Meanwhile, in a region of the reservoir forming substrate 30 facing to the piezoelectric element 300, provided is a piezoelectric element holding portion 33 that can hermetically seal a space, securing the space to an extent that motions of the piezoelectric element 300 are not blocked. Then, at least the piezoelectric active portion 320 of the piezoelectric element 300 is sealed in this piezoelectric element holding portion 33 to prevent damage to the piezoelectric element 300 caused by an external environment such as moisture in the air.

Note that the ink-jet recording head thus constituted takes in ink from the ink introducing port 35 connected to external ink supplying means (not shown), and fills the inside thereof from the reservoir 110 to the nozzle orifice 21 with ink. Then, following a recording signal from a drive circuit (not shown), a voltage is applied between the upper electrode film 80 and the lower electrode film 60 to cause flexible deformation in the elastic film 50, the lower electrode film 60 and the piezoelectric layer 70. Then, the pressure in the pressure generating chamber 12 is increased, and the ink droplets are ejected from the nozzle orifice 21.

(Embodiment 2)

Figure 5A:
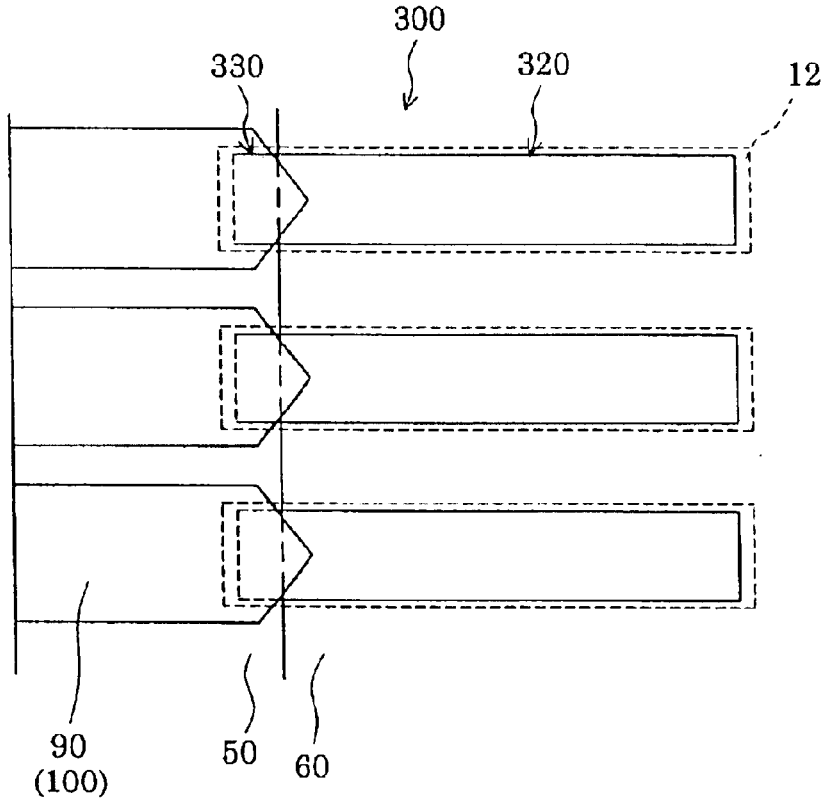
FIGS. 5A and 5B are views of an ink-jet recording head according to embodiment 2 of the present invention.
Figure 5B:
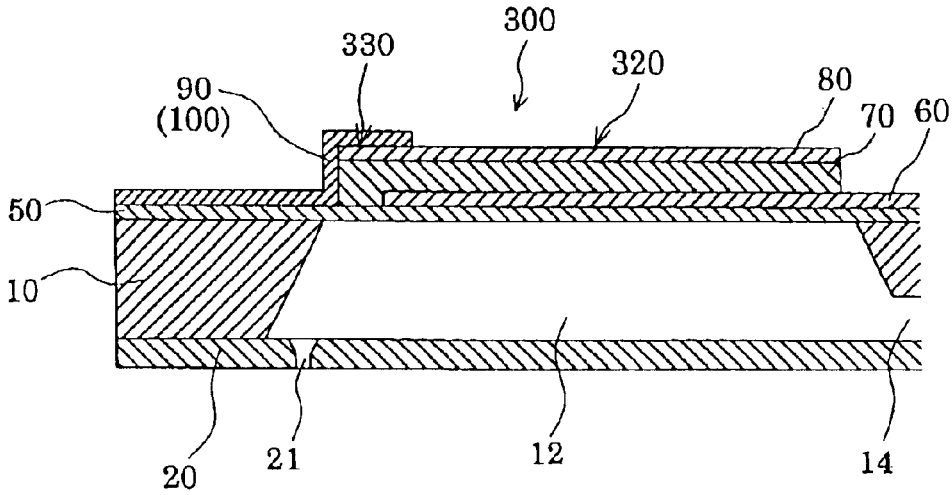

FIGS. 5A and 5B are views showing principal portions of an ink-jet recording head according to embodiment 2: FIG. 5A is a plan view; and FIG. 5B is a sectional view.

This embodiment is an example where the vibration plate in an edge portion of the longitudinal direction of the pressure generating chamber 12 is covered with the lead electrode 90 serving also as the stress suppression layer 100. As shown in FIG. 5A, this embodiment is similar to embodiment 1 except that: a width of the lead electrode 90 in the vicinity of the end portion of sign of the piezoelectric active portion 320 is gradually reduced toward a tip thereof; and the lead electrode 90 is extended with a width wider than that of the pressure generating chamber 12 in an outer region than the boundary between the piezoelectric active portion 320 and the piezoelectric non-active portion 330.

With such a constitution, similarly to embodiment 1, damage to the piezoelectric layer 70 can be prevented. Moreover, since the edge portion of the longitudinal direction of the pressure generating chamber 12 is covered with the lead electrode 90 also serving as the stress suppression layer 100, the rigidity of the vibration plate is enhanced in the edge portion of the pressure generating chamber 12, thus making it possible to simultaneously prevent damage to the vibration plate due to the drive of the piezoelectric element 300.

As described above, the vibration plate of this embodiment is basically constituted of the elastic film 50 and the lower electrode film 60. However, in the edge portion of the longitudinal direction of the pressure generating chamber 12, the vibration plate is constituted only of the elastic film 50 with the lower electrode film 60 removed. Therefore, the film thickness of the vibration plate is thin in the edge portion of the longitudinal direction of the pressure generating chamber 12, bringing thus a possibility of damage to the vibration plate due to repeated deformations by the drive of the piezoelectric element 300. However, since the rigidity of the vibration plate is maintained high by covering the same vibration plate with the lead electrode 90 also serving as the stress suppression layer 100, it is possible to prevent damage to the vibration plate.

Moreover, in this embodiment, the width of the lead electrode 90 in the vicinity of the side edge portion of the piezoelectric active portion 320 is set to be gradually reduced toward the tip thereof. Therefore, when the piezoelectric element 300 is driven, the stress applied to the vicinity of the boundary between the piezoelectric active portion 320 and the piezoelectric non-active portion 330 gradually decreases toward the piezoelectric non-active portion 330. Specifically, the radical stress change in the vicinity of the boundary is suppressed, and thus damage to the piezoelectric layer 70 can be securely prevented.

Figure 6:
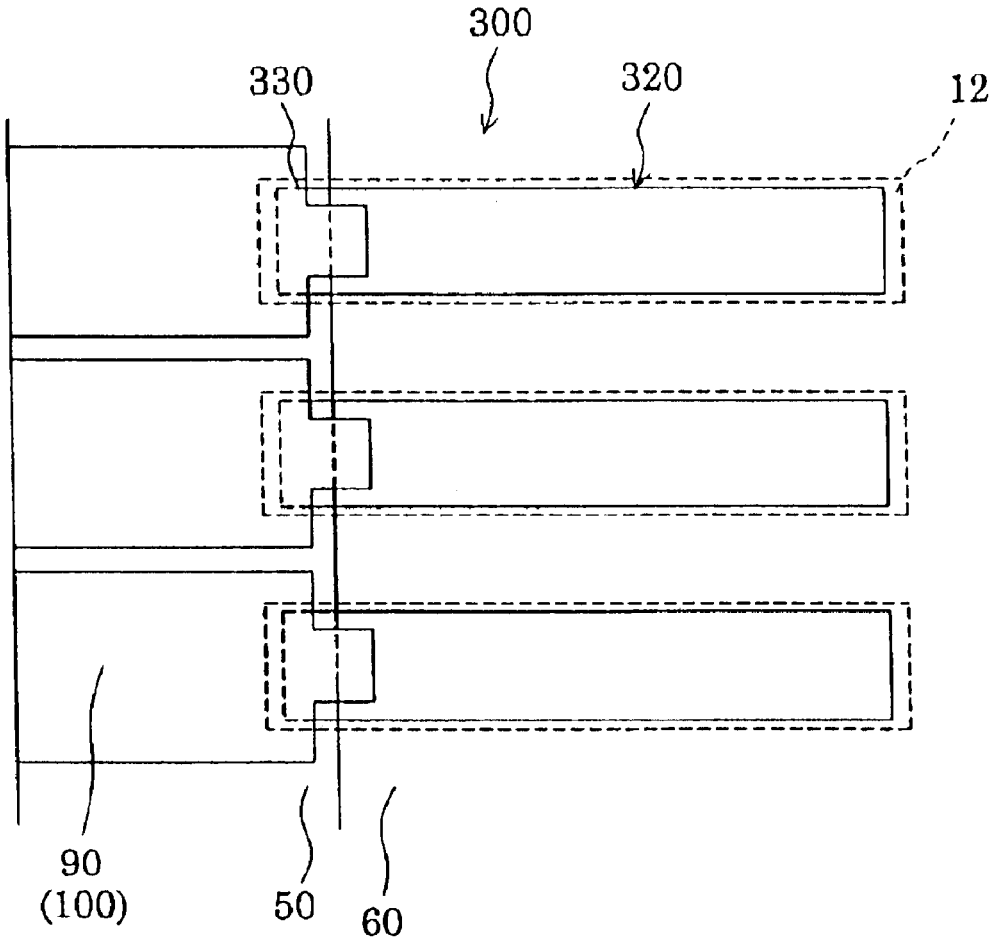
FIG. 6 is a plan view showing another example of the ink-jet recording head according to embodiment 2 of the present invention.

Note that, in this embodiment, the width of the lead electrode 90 in the vicinity of the side edge portion of the piezoelectric active portion 320, the lead electrode 90 also serving as the stress suppression layer 100, is set to be gradually reduced toward the tip thereof. However, the present invention is not limited to this. It is satisfactory as long as the vibration plate in the region facing to the edge portion of the longitudinal direction of the pressure generating chamber 12 is covered, without short-circuiting the wiring of the piezoelectric element 300. For example, as shown in FIG. 6, the lead electrode 90 may be formed to have a width narrower than that of the piezoelectric element 300 in the region facing towards the piezoelectric active portion 320 and to have a width wider than that of the pressure generating chamber 12 in the outer region than the boundary between the piezoelectric active portion 320 and the piezoelectric non-active portion 330.

(Embodiment 3)

Figure 7A:
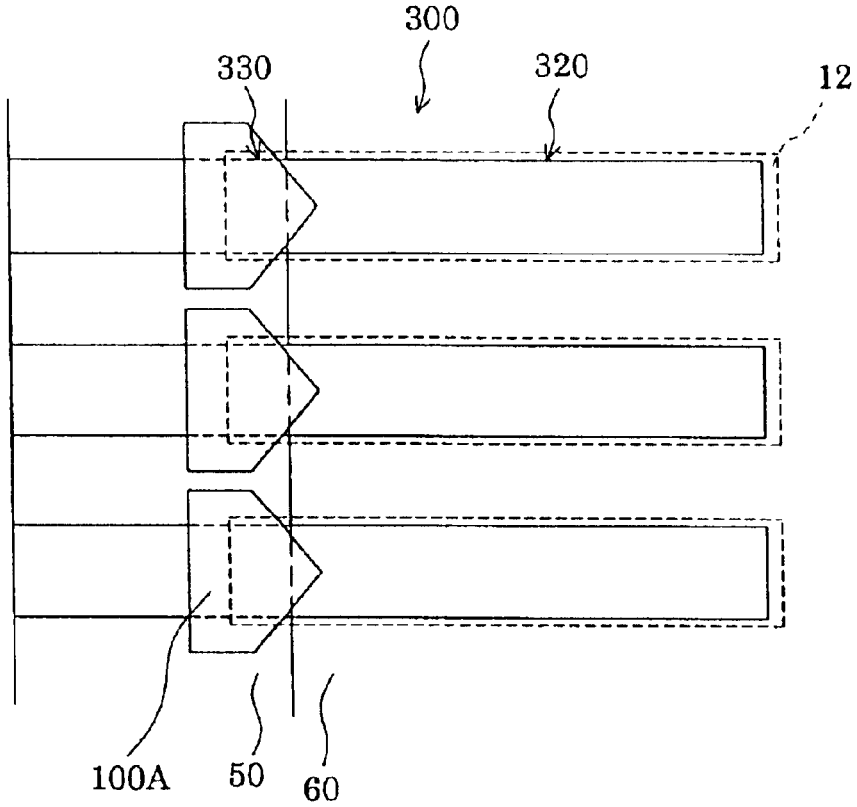
FIGS. 7A and 7B are views of an ink-jet recording head according to embodiment 3 of the present invention.
Figure 7B:
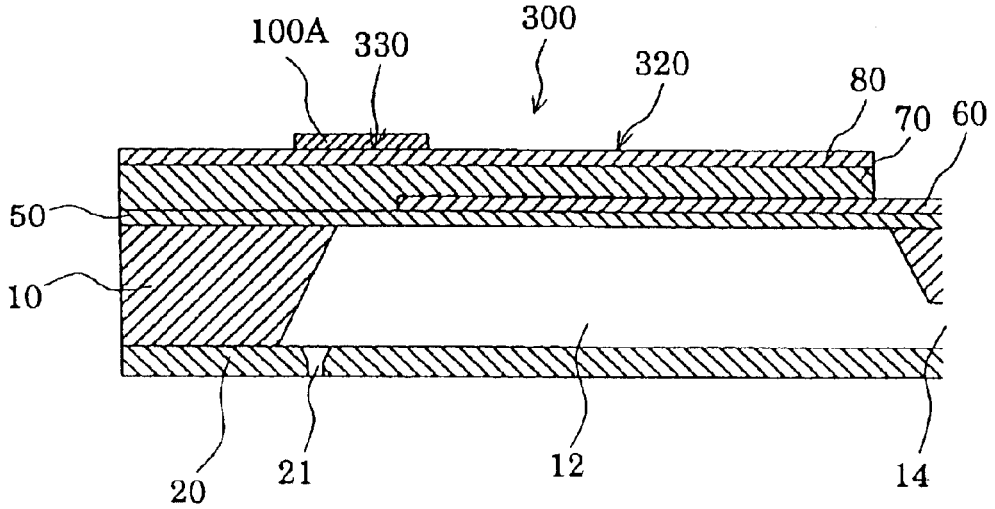

FIGS. 7A and 7B are views showing principal portions of an ink-jet recording head according to embodiment 3.

In the above-described embodiments, the lead electrode 90 is set to serve also as the stress suppression layer 100. However, this embodiment is an example where a stress suppression layer 100A is provided separately from the lead electrode 90.

Specifically, as shown in FIGS. 7A and 7B, in this embodiment, the piezoelectric non-active portion 330 of the piezoelectric element 300 is extended from the region opposite with the pressure generating chamber 12 to a region opposite with a peripheral wall of the pressure generating chamber 12. And, to the vicinity of the end portion of the piezoelectric non-active portion 330, external wiring (not shown) is set to be directly connected. Moreover, in the vicinity of the end portion of the longitudinal direction of the pressure generating chamber 12, the stress suppression layer 100A is formed straddling the boundary between the piezoelectric active portion 320 and the piezoelectric non-active portion 330. Except for the above, this embodiment is similar to embodiment 2.

Here, the stress suppression layer 100A is provided for each piezoelectric element 300 in this embodiment. However, for example, the stress suppression layer 100A may be formed continuously across the piezoelectric elements 300 provided in parallel. Moreover, though the stress suppression layer 100A is preferably formed of an insulating layer made of an insulating material, the stress suppression layer 100A may be formed of a conductive material if there is no possibility of a short circuit in the wiring of each piezoelectric element.

It is a matter of course that a similar effect to that of the above-described embodiments can be obtained with such a constitution.

(Other Embodiment)

As seen above, description has been made for each embodiment of the present invention, but the basic constitution of the ink-jet recording head is not limited to the above-described ones.

For example, in the above-described embodiments, the piezoelectric non-active portion 330 is formed by removing the lower electrode film 60. However, the present invention is not limited to this. For example, the piezoelectric non-active portion 330 may be formed by providing a low dielectric insulating layer between the piezoelectric layer 70 and the upper electrode film 80. Furthermore, the piezoelectric layer 70 may be partially doped and made inert to form the piezoelectric non-active portion 330.

Figure 8:
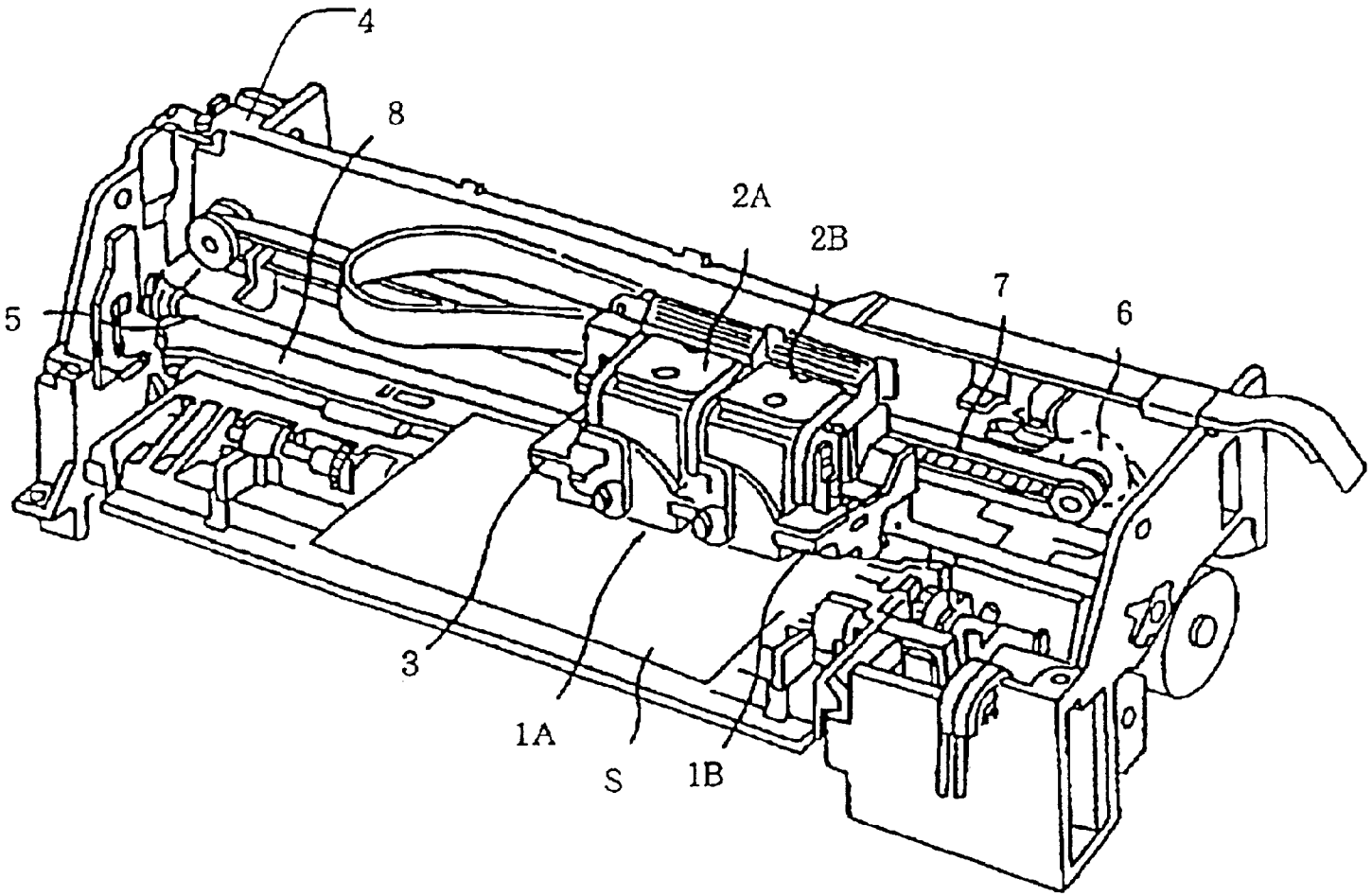
FIG. 8 is a schematic view of an ink-jet recording apparatus according to one embodiment of the present invention.

Moreover, the ink-jet recording head of each embodiment constitutes a part of a recording head unit including an ink passage communicating with an ink cartridge and the like, and is mounted in an ink-jet recording apparatus. FIG. 8 is a schematic view showing one example of the ink-jet recording apparatus.

As shown in FIG. 8, in recording head units 1A and 1B having the ink-jet recording heads, cartridges 2A and 2B constituting ink supplying means are detachably provided. A carriage 3 having the recording head units 1A and 1B mounted thereon is provided on a carriage shaft 5 attached onto an apparatus body 4 so as to be freely movable in a shaft direction. These recording head units 1A and 1B are set to eject a black ink composition and a color ink composition, respectively.

And, drive force of a drive motor 6 is transmitted to the carriage 3 via a plurality of gears (not shown) and a timing belt 7, and thus the carriage 3 mounting the recording head units 1A and 1B moves along the carriage shaft 5. Meanwhile, a platen 8 is provided along the carriage shaft 5 in the apparatus body 4, and a recording sheet S as a recording medium such as a sheet of paper fed by a paper feeding roller (not shown) is set to be conveyed on the platen 8.

As described above, in the present invention, the stress suppression layer straddling the boundary between the piezoelectric active portion and the piezoelectric non-active portion is provided on the end portion of the longitudinal direction of the piezoelectric element having the piezoelectric active portion and the piezoelectric non-active portion. Therefore, the rigidity in the vicinity of the end portion of the longitudinal direction of the piezoelectric element is enhanced, and thus the stress applied to the piezoelectric element during the drive thereof is suppressed. Thus, prevention of damage to the piezoelectric layer is made possible. Particularly, since the radical stress change at the boundary between the piezoelectric active portion and the piezoelectric non-active portion can be prevented, damage to the piezoelectric layer accompanied with the stress change in this boundary portion can be effectively prevented.

What is claimed is:

1. An ink-jet recording head, comprising:

a pressure generating chamber communicating with a nozzle orifice; and a piezoelectric element having a lower electrode, a piezoelectric layer and an upper electrode, said piezoelectric element being provided in a region corresponding to said pressure generating chamber with a vibration plate interposed therebetween, wherein a piezoelectric active portion as a substantial drive portion of said piezoelectric element and a piezoelectric non-active portion having said piezoelectric layer continuous from the piezoelectric active portion but not being substantially driven are provided in a region facing towards said pressure generating chamber, and a stress suppression layer for suppressing stress due to drive of the piezoelectric element is provided straddling a boundary between said piezoelectric active portion and said piezoelectric non-active portion, wherein said stress suppression layer is formed to have a width wider than a width of said pressure generating chamber in an outer region than at the boundary between said piezoelectric active portion and said piezoelectric non-active portion, and the vibration plate in a region opposite with an edge portion of a longitudinal direction of said pressure generating chamber is covered with the stress suppression layer.

2. The ink-jet recording head according to claim 1, wherein a width of the portion of said stress suppression layer straddling a boundary between said piezoelectric active portion and said piezoelectric non-active portion is constant.

3. The ink-jet recording head according to claim 1, wherein a width of an end portion of said stress suppression layer on said piezoelectric active portion side is gradually reduced toward a tip thereof.

4. The ink-jet recording head according to claim 1, wherein said piezoelectric layer has crystals subjected to a priority orientation.

5. The ink-jet recording head according to claim 4, wherein said piezoelectric layer has crystals shaped in a columnar shape.

6. The ink-jet recording head according to claim 1, wherein said piezoelectric non-active portion is formed by removing said lower electrode.

7. The ink-jet recording head according to claim 1, wherein a film thickness of said piezoelectric layer ranges from 0.5 to 3 $\mu$m.

8. The ink-jet recording head according to claim 1, wherein at least said piezoelectric layer constituting said piezoelectric element is independently formed in the region opposite with said pressure generating chamber.

9. The ink-jet recording head according to claim 8, wherein a wiring electrode is extended from said upper electrode toward a region of a peripheral wall of the pressure generating chamber.

10. The ink-jet recording head according to claim 9, wherein said wiring electrode also serves as said stress suppression layer.

11. The ink-jet recording head according to claim 1, wherein said stress suppression layer includes an insulating layer made of an insulating material.

12. The ink-jet recording head according to claim 1, wherein the ink-jet recording head further comprises a plate joined to said passage-forming substrate on the surface where said piezoelectric element is formed, wherein the plate includes a piezoelectric element holding portion capable of sealing a space in a state where the space is secured for said piezoelectric element such that the movement thereof is not interfered with, in a region opposite to said piezoelectric element.

13. The ink-jet recording head according to claim 1, wherein said pressure generating chamber is formed by subjecting a single crystal silicon substrate to anisotropic etching, and each layer of said piezoelectric element is formed of a thin film by a lithography method.

14. An ink-jet recording apparatus comprising the ink-jet recording head according to any one of claims 1 to 13.

* * * * *

UNITED STATES PATENT AND TRADEMARK OFFICE

CERTIFICATE OF CORRECTION

PATENT NO. : 6,764,167 B2
DATED : July 20, 2004
INVENTOR(S) : Shimada, Masato et al.

It is certified that error appears in the above-identified patent and that said Letters Patent is hereby corrected as shown below:

Title page, Item [54] and Column 1, line 1,
Title, please amend as follows:
-- INK-JET RECORDING HEAD AND INK-JET RECORDING APPARATUS --.

Signed and Sealed this

Twenty-third Day of August, 2005

JON W. DUDAS
*Director of the United States Patent and Trademark Office*